US008739549B2

(12) United States Patent
Steinhaus

(10) Patent No.: US 8,739,549 B2
(45) Date of Patent: Jun. 3, 2014

(54) SYSTEMS AND METHODS FOR FEEDSTOCK INJECTION

(75) Inventor: Benjamin Campbell Steinhaus, Missouri City, TX (US)

(73) Assignee: General Electric Company, Schenectady, NY (US)

( * ) Notice: Subject to any disclaimer, the term of this patent is extended or adjusted under 35 U.S.C. 154(b) by 1093 days.

(21) Appl. No.: 12/755,369

(22) Filed: Apr. 6, 2010

(65) Prior Publication Data

US 2011/0239658 A1 Oct. 6, 2011

(51) Int. Cl.
*F02C 1/00* (2006.01)

(52) U.S. Cl.
USPC ..... 60/772; 60/781

(58) Field of Classification Search
USPC ..... 60/39.281, 39.465, 740, 742, 746, 781, 60/772; 239/416.5, 422, 422.5
See application file for complete search history.

(56) References Cited

U.S. PATENT DOCUMENTS

| | | | | |
|---|---|---|---|---|
| 4,502,633 | A * | 3/1985 | Saxon | 239/132.3 |
| 4,705,535 | A * | 11/1987 | Lipp | 48/77 |
| 6,892,654 | B2 * | 5/2005 | Whittaker et al. | 110/260 |
| 7,506,822 | B2 * | 3/2009 | Cairo et al. | 239/1 |
| 2004/0261671 | A1 | 12/2004 | Taylor | |
| 2006/0199119 | A1 | 9/2006 | Abbasi | |
| 2009/0173484 | A1 | 7/2009 | Storey | |
| 2009/0272034 | A1 * | 11/2009 | Guo | 48/62 R |
| 2010/0294858 | A1 | 11/2010 | Steinhaus | |

FOREIGN PATENT DOCUMENTS

| | | | |
|---|---|---|---|
| EP | 0421820 | A2 | 4/1991 |
| EP | 2113717 | A2 | 11/2009 |
| GB | 2427261 | A | 12/2006 |
| WO | 2006/078543 | A2 | 7/2006 |
| WO | 2009/134530 | A2 | 11/2009 |

OTHER PUBLICATIONS

PCT Search Report issued in connection with corresponding WO Patent Application No. US2011/028334 filed on Mar. 14, 2011.

* cited by examiner

*Primary Examiner* — Phutthiwat Wongwian
(74) *Attorney, Agent, or Firm* — Fletcher Yoder P.C.

(57) ABSTRACT

Systems and methods for injection of feedstock are included. In one embodiment, a system includes a solid fuel injector. The solid fuel injector includes a solid fuel passage, a first gas passage, and a second gas passage. The solid fuel passage is configured to inject a solid fuel through a fuel outlet in a fuel direction. The first gas passage is configured to inject a first gas through a first gas outlet in a first gas direction. The second gas passage is configured to inject a second gas through a second gas outlet in a second gas direction. The first gas direction is oriented at a first angle relative to the fuel direction. The second gas direction is oriented at a second angle relative to the fuel direction, and the first and second angles are different from one another.

19 Claims, 5 Drawing Sheets

SYSTEMS AND METHODS FOR FEEDSTOCK INJECTION

BACKGROUND OF THE INVENTION

The subject matter disclosed herein relates to systems and methods for injecting a feedstock. More specifically, the subject matter disclosed herein relates to the injection of feedstock for gasification operations.

Some power plants, for example, integrated gasification combined cycle (IGCC) power plants, utilize a carbonaceous fuel to produce energy, typically in the form of electrical power. The carbonaceous fuel, for example coal, may be processed by a fuel preparation unit and injected into a gasifier for gasification. Gasification involves reacting a carbonaceous fuel and oxygen at a very high temperature to produce syngas, i.e., a fuel containing carbon monoxide and hydrogen, which burns much more efficiently and cleaner than the fuel in its original state. The syngas may be fed into a combustor of a gas turbine of the IGCC power plant and ignited to power the gas turbine, which may drive a load such as an electrical generator. Typical gasifier fuel injectors may not optimally inject the carbonaceous fuel so as to enhance fuel efficiency and burn characteristics. Accordingly, there is a need for systems and methods that may enhance efficiency of the carbonaceous fuel injection into the gasifier.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a solid fuel injector. The solid fuel injector comprises a solid fuel passage, a first gas passage, and a second gas passage. The solid fuel passage is configured to inject a solid fuel through a fuel outlet in a fuel direction. The first gas passage is configured to inject a first gas through a first gas outlet in a first gas direction. The second gas passage is configured to inject a second gas through a second gas outlet in a second gas direction. The first gas direction is oriented at a first angle relative to the fuel direction. The second gas direction is oriented at a second angle relative to the fuel direction, and the first and second angles are different from one another.

In a second embodiment, a system includes a solid fuel injection controller and a solid fuel injector. The solid fuel injection controller is configured to control a solid fuel flow rate of a solid fuel in a fuel direction from the solid fuel injector, a first gas flow rate of a first gas in a first gas direction from the solid fuel injector, and a second gas flow rate of a second gas in a second gas direction from the solid fuel injector.

In a third embodiment, a method includes controlling a solid fuel flow rate of a solid fuel in fuel direction from a solid fuel injector, controlling a first gas flow rate of a first gas in a first gas direction from the solid fuel injector, and controlling a second gas flow rate of a second gas in a second gas direction from the solid fuel injector. The first gas direction is oriented at a first angle relative to the fuel direction. The second gas direction is oriented at a second angle relative to the fuel direction, and the first and second angles are different from one another.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Figure 1:
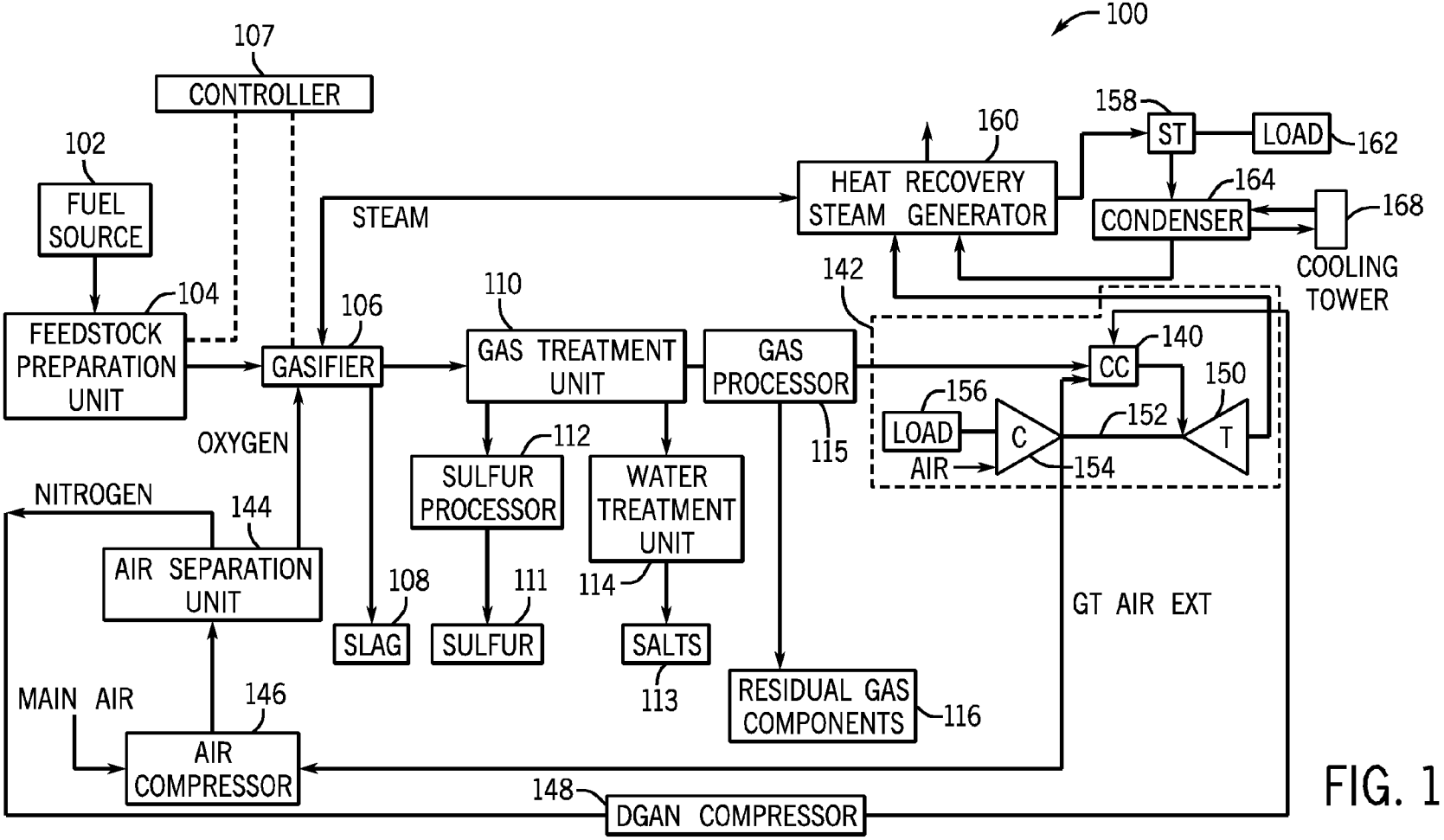
FIG. 1 depicts a block diagram of an embodiment of an integrated gasification combined cycle (IGCC) power plant, including a gasifier.

Gasification power plants, such as the IGCC power plant described in more detail below with respect to FIG. 1, are capable of gasifying a carbonaceous fuel to produce a syngas. The carbonaceous fuel, for example coal, may be processed by a fuel preparation unit and injected into a gasifier by using a fuel injector. Fuel injector embodiments, described in more detail below, are capable of more efficiently injecting the fuel by controlling various properties of a conical spray of feedstock, such as opening angle and size of the conical spray. The opening angle and size may be controlled, for example, by using a gasification controller to vary the flow rate of feedstock and a gas through various fuel and gas passages included in the fuel injector. The conical spray may be controlled to realize improvements in gasification performance and/or to increase the lifespan of IGCC components. Indeed, the fuel injector embodiments described herein are capable of enhancing fuel efficiency and burn characteristics of the gasification process.

With the foregoing in mind, FIG. 1 depicts an embodiment of an IGCC power plant 100 that may produce and burn a synthetic gas, i.e., syngas. Elements of the IGCC power plant 100 may include a fuel source 102, such as a solid feed, that may be utilized as a source of energy for the IGCC power plant 100. The fuel source 102 may include coal, petroleum coke, biomass, wood-based materials, agricultural wastes, tars, coke oven gas and asphalt, or other carbon containing items.

The solid fuel of the fuel source 102 may be passed to a feedstock preparation unit 104. The feedstock preparation unit 104 may, for example, resize or reshape the fuel source 102 by chopping, milling, shredding, pulverizing, briquetting, or palletizing the fuel source 102 to generate feedstock. Additionally, water or other suitable liquids may be added to the fuel source 102 in the feedstock preparation unit 104 to create slurry feedstock. In certain embodiments, no liquid is added to the fuel source, thus yielding dry feedstock. The feedstock may be conveyed into a gasifier 106 for use in gasification operations.

In certain embodiments, as described in more detail below with respect to FIG. 2, the gasifier 106 includes a gasification controller 107 capable of on-line control of the injection of feedstock (i.e., fuel) and gas for use in gasification operations. The gasification controller 107 may control one or more fuel injectors so as to create a conical spray or spray cone of feedstock used by the gasifier 106. Characteristics of the conical spray or spray cone of feedstock such as the size of the spray and the opening angle of the conical spray or spray cone may be varied during operations of the gasifier 106, for example, to more efficiently burn a variety of different fuels and fuel mixtures. The gasifier 106 may convert the feedstock spray into a syngas, e.g., a combination of carbon monoxide and hydrogen. This conversion may be accomplished by subjecting the feedstock to a controlled amount of any moderator and limited oxygen at elevated pressures (e.g., from approximately 400 pounds per square inch gauge (PSIG)-1500 PSIG) and elevated temperatures (e.g., approximately 2200° F.-2700° F.), depending on the type of feedstock used. The heating of the feedstock during a pyrolysis process may generate a solid (e.g., char) and residue gases (e.g., carbon monoxide, hydrogen, and nitrogen).

A combustion process may then occur in the gasifier 106. The combustion may include introducing oxygen to the char and residue gases. The char and residue gases may react with the oxygen to form carbon dioxide and carbon monoxide, which provides heat for the subsequent gasification reactions. The temperatures during the combustion process may range from approximately 2200° F. to approximately 2700° F. In addition, steam may be introduced into the gasifier 106. The gasifier 106 utilizes steam and limited oxygen to allow some of the feedstock to be burned to produce carbon monoxide and energy, which may drive a second reaction that converts further feedstock to hydrogen and additional carbon dioxide.

In this way, a resultant gas is manufactured by the gasifier 106. This resultant gas may include approximately 85% of carbon monoxide and hydrogen in equal proportions, as well as $CH_4$, HCl, HF, COS, $NH_3$, HCN, and $H_2S$ (based on the sulfur content of the feedstock). This resultant gas may be termed untreated syngas, since it contains, for example, $H_2S$. The gasifier 106 may also generate waste, such as slag 108, which may be a wet ash material. This slag 108 may be removed from the gasifier 106 and disposed of, for example, as road base or as another building material. To treat the untreated syngas, a gas treatment unit 110 may be utilized. In one embodiment, the gas treatment unit 110 may be a water gas shift reactor. The gas treatment unit 110 may scrub the untreated syngas to remove the HCl, HF, COS, HCN, and $H_2S$ from the untreated syngas, which may include separation of sulfur 111 in a sulfur processor 112 by, for example, an acid gas removal process in the sulfur processor 112. Furthermore, the gas treatment unit 110 may separate salts 113 from the untreated syngas via a water treatment unit 114 that may utilize water purification techniques to generate usable salts 113 from the untreated syngas. Subsequently, the gas from the gas treatment unit 110 may include treated syngas, (e.g., the sulfur 111 has been removed from the syngas), with trace amounts of other chemicals, e.g., $NH_3$ (ammonia) and $CH_4$ (methane).

A gas processor 115 may be used to remove additional residual gas components 116, such as ammonia and methane, as well as methanol or any residual chemicals from the treated syngas. However, removal of residual gas components from the treated syngas is optional, since the treated syngas may be utilized as a fuel even when containing the residual gas components, e.g., tail gas. At this point, the treated syngas may include approximately 3% CO, approximately 55% $H_2$, and approximately 40% $CO_2$ and is substantially stripped of $H_2S$.

Continuing with the syngas processing, once the $CO_2$ has been captured from the syngas, the treated syngas may be then transmitted to a combustor 140, e.g., a combustion chamber, of a gas turbine engine 142 as combustible fuel. The IGCC power plant 100 may further include an air separation unit (ASU) 144. The ASU 144 may operate to separate air into component gases by, for example, distillation techniques. The ASU 144 may separate oxygen from the air supplied to it from a supplemental air compressor 146, and the ASU 144 may transfer the separated oxygen to the gasifier 106. Additionally the ASU 144 may transmit separated nitrogen to a diluent nitrogen (DGAN) compressor 148.

The DGAN compressor 148 may compress the nitrogen received from the ASU 144 at least to pressure levels equal to those in the combustor 140, so as not to interfere with the proper combustion of the syngas. Thus, once the DGAN compressor 148 has adequately compressed the nitrogen to a proper level, the DGAN compressor 148 may transmit the compressed nitrogen to the combustor 140 of the gas turbine engine 142. The nitrogen may be used as a diluent to facilitate control of emissions, for example.

As described previously, the compressed nitrogen may be transmitted from the DGAN compressor 148 to the combustor 140 of the gas turbine engine 142. The gas turbine engine 142 may include a turbine 150, a drive shaft 152 and a compressor 154, as well as the combustor 140. The combustor 140 may receive fuel, such as syngas, which may be injected under pressure from fuel nozzles. This fuel may be mixed with compressed air as well as compressed nitrogen from the DGAN compressor 148, and combusted within combustor 140. This combustion may create hot pressurized exhaust gases.

The combustor 140 may direct the exhaust gases towards an exhaust outlet of the turbine 150. As the exhaust gases from the combustor 140 pass through the turbine 150, the exhaust gases force turbine blades in the turbine 150 to rotate the drive shaft 152 along an axis of the gas turbine engine 142. As illustrated, the drive shaft 152 is connected to various components of the gas turbine engine 142, including the compressor 154.

The drive shaft 152 may connect the turbine 150 to the compressor 154 to form a rotor. The compressor 154 may include blades coupled to the drive shaft 152. Thus, rotation of turbine blades in the turbine 150 may cause the drive shaft 152 connecting the turbine 150 to the compressor 154 to rotate blades within the compressor 154. This rotation of blades in the compressor 154 causes the compressor 154 to compress air received via an air intake in the compressor 154. The compressed air may then be fed to the combustor 140 and mixed with fuel and compressed nitrogen to allow for higher efficiency combustion. Drive shaft 152 may also be connected to load 156, which may be a stationary load, such as an electrical generator for producing electrical power, for example, in a power plant. Indeed, load 156 may be any suitable device that is powered by the rotational output of the gas turbine engine 142.

The IGCC power plant 100 also may include a steam turbine engine 158 and a heat recovery steam generation (HRSG) system 160. The steam turbine engine 158 may drive a second load 162. The second load 162 may also be an electrical generator for generating electrical power. However, both the first and second loads 156, 162 may be other types of loads capable of being driven by the gas turbine engine 142 and steam turbine engine 158. In addition, although the gas turbine engine 142 and steam turbine engine 158 may drive separate loads 156 and 162, as shown in the illustrated embodiment, the gas turbine engine 142 and steam turbine engine 158 may also be utilized in tandem to drive a single load via a single shaft. The specific configuration of the steam turbine engine 158, as well as the gas turbine engine 142, may be implementation-specific and may include any combination of sections.

The IGCC power plant 100 may also include the HRSG 160. Heated exhaust gas from the gas turbine engine 142 may be transported into the HRSG 160 and used to heat water and produce steam used to power the steam turbine engine 158. Exhaust from, for example, a low-pressure section of the steam turbine engine 158 may be directed into a condenser 164. The condenser 164 may utilize a cooling tower 168 to exchange heated water for chilled water. The cooling tower 168 acts to provide cool water to the condenser 164 to aid in condensing the steam transmitted to the condenser 164 from the steam turbine engine 158. Condensate from the condenser 164 may, in turn, be directed into the HRSG 160. Again, exhaust from the gas turbine engine 142 may also be directed into the HRSG 160 to heat the water from the condenser 164 and produce steam.

In combined cycle power plants such as IGCC power plant 100, hot exhaust may flow from the gas turbine engine 142 and pass to the HRSG 160, where it may be used to generate high-pressure, high-temperature steam. The steam produced by the HRSG 160 may then be passed through the steam turbine engine 158 for power generation. In addition, the produced steam may also be supplied to any other processes where steam may be used, such as to the gasifier 106. The gas turbine engine 142 generation cycle is often referred to as the "topping cycle," whereas the steam turbine engine 158 generation cycle is often referred to as the "bottoming cycle." By combining these two cycles as illustrated in FIG. 1, the IGCC power plant 100 may lead to greater efficiencies in both cycles. In particular, exhaust heat from the topping cycle may be captured and used to generate steam for use in the bottoming cycle.

Figure 2:
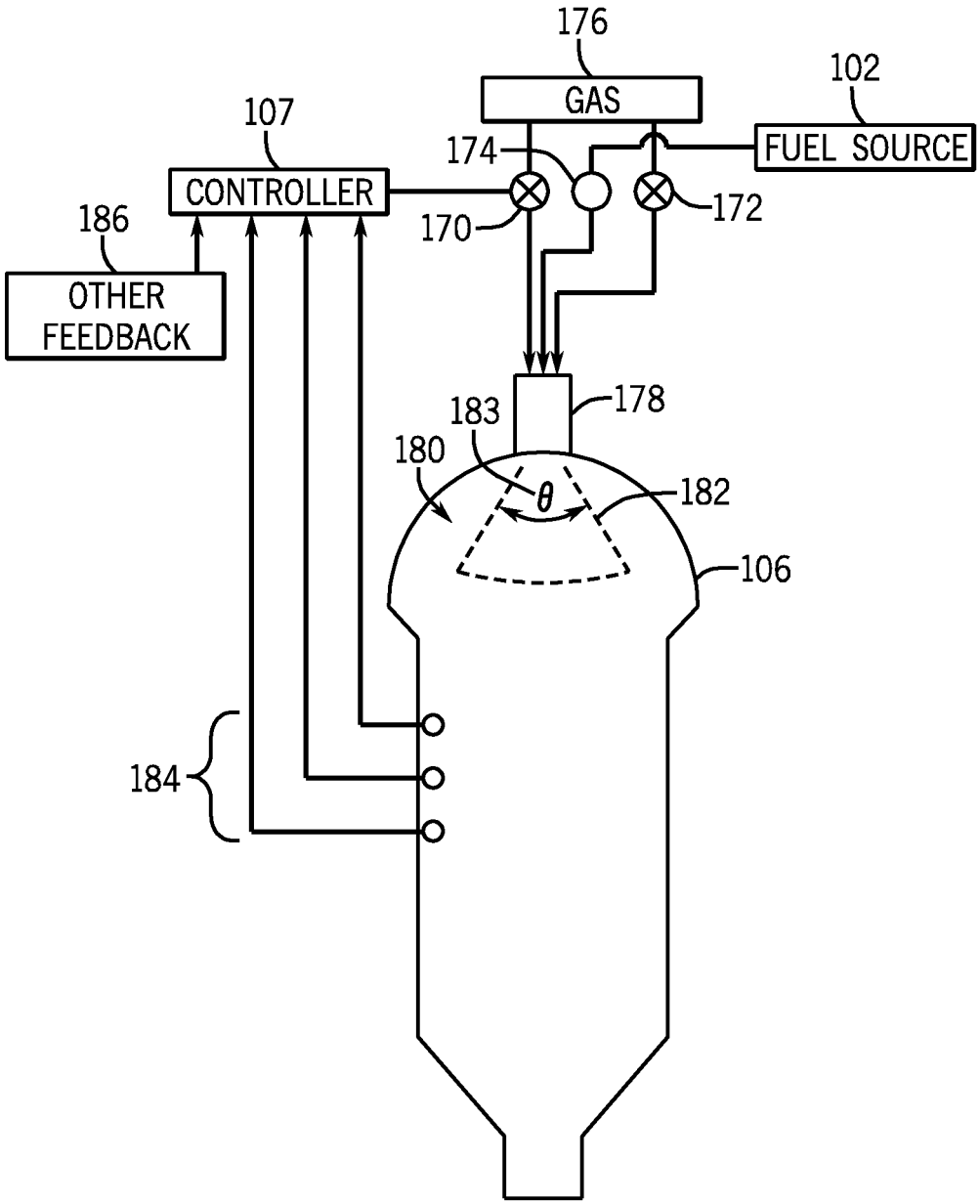
FIG. 2 depicts a schematic view of an embodiment of the gasifier depicted in FIG. 1.

FIG. 2 depicts a schematic view of an embodiment of the gasifier 106 coupled to an embodiment of the gasification controller 107. More specifically, the gasification controller 107 is communicatively coupled to a set of valves 170, 172, and a feed pump 174 for use in fuel injection. The valves 170, 172 may be used to adjust (e.g., increase or decrease) a gas 176, such as oxygen, flowing into a gasification fuel injector 178 of the gasifier 106. Additionally, the feed pump 174 may be used to adjust the flow of feedstock from the fuel source 102 into the fuel injector 178. While the depicted embodiment of the gasifier 106 includes a single gasification fuel injector 178, other embodiments of the gasifier 106 may include a plurality of gasification fuel injectors 178.

As mentioned above with respect to FIG. 1, the gasifier 106 is utilized to convert feedstock into syngas. In certain embodiments, the feedstock may be a solid feedstock entrained in a carrier gas (e.g., nitrogen or $CO_2$). For example, the solid feedstock may include coal particles, biomass particles, and other feedstock particles, entrained in the carrier gas, Consequently, the gas-entrained feedstock may be caused to flow like a fluid. In other embodiments, the feedstock may be a slurry feedstock. The controller 107 may adjust the feed pump 174 so as to redirect the feedstock from the fuel source 102 into the gasification fuel injector 178. Additionally, the controller 107 may adjust the valves 170 and 172, so as to redirect a gas, such as oxygen, into the gasification fuel injector 178. The gasification fuel injector 178 may subsequently create a spray of the feedstock in a combustion chamber 180 of the gasifier 106 by combining the flow of the feedstock with the flow of oxygen, as described in more detail with respect to FIG. 3 below. The spray is capable of atomizing the feedstock into a spray cone 182 of feedstock particulate, as illustrated. The atomizing of the feedstock helps the mixing and dispersal of fuel and gas in the combustion chamber of the gasifier 106, thereby helping improve gasification. The spray cone 182 of feedstock particulate includes an opening angle θ183. The opening angle θ183 is a two-dimensional vertex angle made by a cross section through the vertex (i.e., top of the cone) and center of the base (i.e. bottom) of the three-dimensional cone.

The controller 107 may vary the opening angle θ183 and the size (e.g. height, width) of the spray cone 182 so as to optimally control the burn characteristics and fuel efficiency of the gasifier 106. The controller may also optimally control the breakup and/or dispersal of the fuel. Accordingly, the controller may be communicatively coupled to a plurality of sensors 184 that are capable of sensing gasification measurements such as temperature, pressure, humidity, moderator flow rate, flame characteristics, spray cone characteristics, and so forth, from various locations inside and outside of the gasifier 106. Additionally, the controller 107 may receive other feedback 186 from IGCC plant 100 components such as air separation components, syngas processing components, sulfur processing components, and so forth. Consequently, the controller 107 is capable of processing the sensor 184 information and other feedback 186 so as to efficiently control the opening angle θ183 and/or the spray cone 182 size, as described in more detail with respect to FIG. 3 below.

Figure 3:
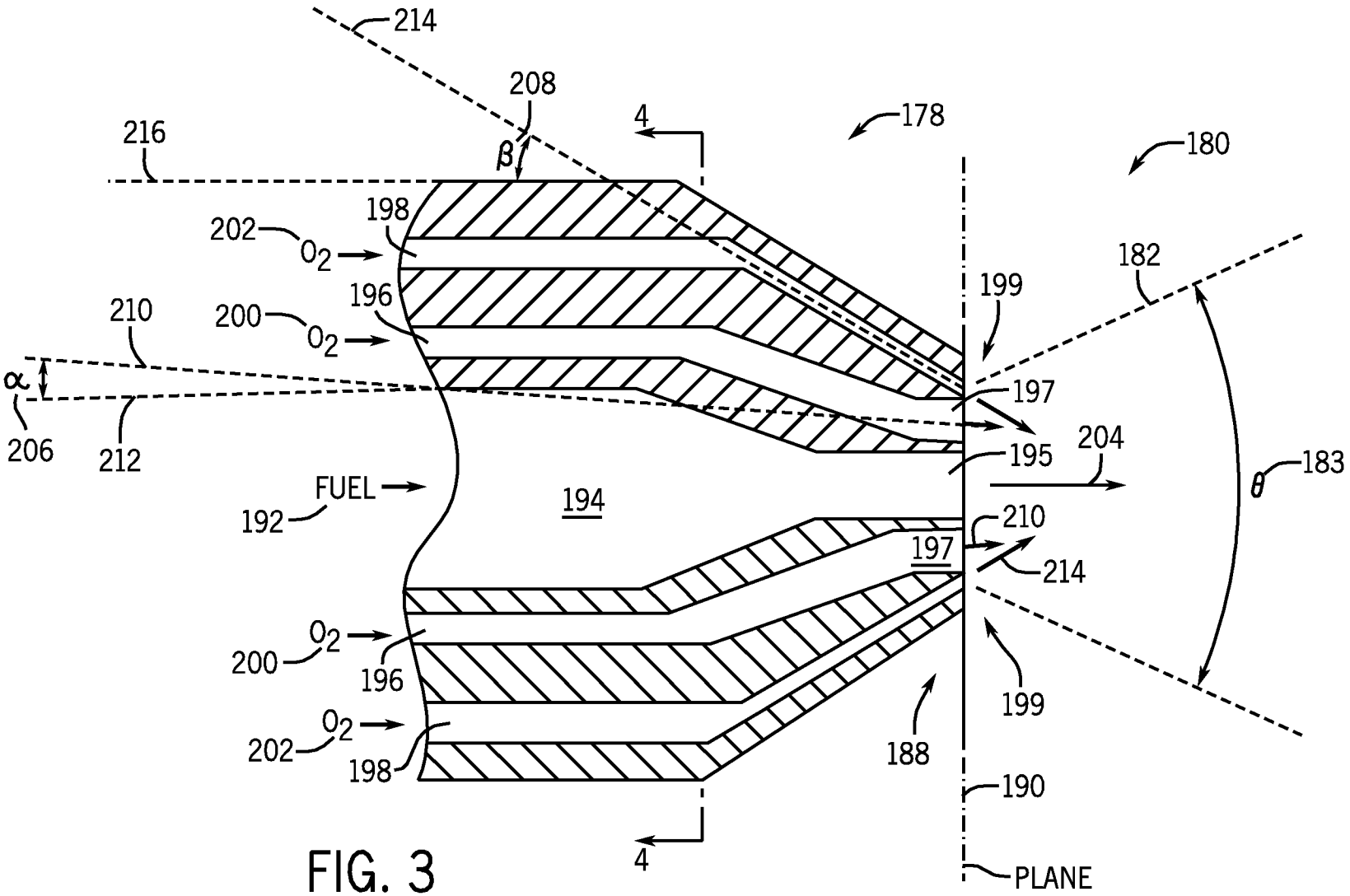
FIG. 3 depicts a cross-sectional side view of an embodiment of a gasification fuel injector.

FIG. 3 is a cross-sectional side view of an embodiment of the gasification fuel injector 178. In the depicted embodiment, the gasification fuel injector 178 is a flush-mounted gasification fuel injector 178. That is, a bottom portion 188 of the gasification fuel injector 178 is mounted flush with a plane, such as a plane 190, so as to not traverse the plane 190. In the depicted embodiment, the plane 190 represents a lower surface of the combustion chamber 180 of the gasifier 106. Consequently, the gasification fuel injector 178 does not traverse the plane 190 into the combustion chamber 180. In other embodiments, the gasification fuel injector 178 may not be flush mounted and may traverse the plane 190 into the combustion chamber 180 of the gasifier 106.

The gasification fuel injector 178 is capable of injecting a fuel 192 redirected from the fuel source 102 and an oxidation gas, such as oxygen, into the combustion chamber 180 of the gasifier 106. Accordingly, the gasification fuel injector 178 includes a fuel passage 194 and two annular gas passages 196, 198. The fuel passage 194 may be used to inject a flow of the fuel 192, such as the gas entrained feedstock, outwardly through a fuel outlet 195 into the gasifier 106. The first annular gas passage 196 may be used to direct a first flow 200 of oxygen outwardly through a first gas outlet 197 into the gasifier 106. The second annular gas passage 198 may be used to direct a second flow 202 of oxygen outwardly through a second gas outlet 199 into the gasifier 106. The outlets 195, 197, and 199 may be disposed in the common plane 190, as illustrated. By controlling the flow ratio through the two passages 194 and 198, the gasification fuel injector 178 is able to optimally define the spray cone 182 of feedstock particulate. Indeed, the gasification fuel injector 178 is capable of defining any number of spray cone 182 sizes and opening angles θ183 as described below.

The spray cone 182 of feedstock particulate may be created by combining the injection of feedstock 192 flowing through the fuel passage 194 with the first gas flow 200 and/or the second gas flow 202 flowing through the two annular gas passages 196, 198 as follows. The feedstock particulate may be directed to flow in an axial direction 204 into the combustion chamber 180 of the gasifier 106. The feedstock particulate may then encounter the first and/or the second gas flows 200, 202. The first gas flow 200 may be entering the combustion chamber 180 at an angle α206 relative to the directional axis 204. The second gas flow 202 may be entering the combustion chamber 180 at an angle β208 relative to the directional axis 204. Accordingly, the first gas flow 200 may be represented by a flow vector 210 relative to an axis 212 while the second gas flow 202 may be represented by a flow vector 214 relative to an axis 216. In certain embodiments, such as the depicted embodiment, the axes 204, 212, and 216, are parallel with respect to one another. Accordingly, the angle α206 of the flow vector 210 is a smaller angle than the angle β208 of the flow vector 214. In certain embodiments, the angle α206 may be between approximately 0° and 70°, and the angle β208 may be between 0° and 5°, 15°, 30°, 45°, or 75°. In certain embodiments, the angle β208 may be approximately 5° to 75° greater than the angle α206.

The first flow of gas 200 represented by the flow vector 210 is capable of impacting the stream of fuel 192, causing a shear stress in the stream of fuel 192. The shear stress is capable of atomizing the stream of fuel 192 into fine particulate matter, creating the spray cone 182 of particulate matter. Increasing the flow rate and/or pressure of the first flow of gas 200 will result in additional shear stress, and thus increase the amount of atomization of the stream of fuel 192 as well as the height, width, and opening angle θ183 of the spray cone 182. The enlarged spray cone 182 may thus cause the particles of the fuel 192 to become more evenly and more widely distributed inside of the combustion chamber 180. A wider spray cone 180 distribution may be useful for separating and exposing more of the particles of fuel 192 to gasification reactions. Consequently, better fuel distribution as well as increased reactions and higher gasification yields may result. However, creating an overly broad spray cone 182 may result in gasification inefficiencies due to, for example, high temperatures and/or pressures inside the gasifier 106. Accordingly, the second flow of gas 202 represented by the flow vector 210 may be used to reduce and/or refine the spray cone 182.

The second flow of gas 202 is capable of impacting the stream of fuel 192 at a larger angle β208 than the angle α206 of the first flow of gas 200. Additionally, the second flow of gas 202 may exit the fuel injector 178 at the second outlet 199 having a larger diameter than the first outlet 197 of the first flow of gas 200. In the depicted embodiment, the second outlet 199 is placed so as to concentrically surround the first outlet 197. Consequently, the second flow of gas 202 is capable of reducing the opening angle θ183 of the spray cone 182 by causing a circumferential gas envelope to develop and surround the spray cone 182. The second flow of gas 202 may envelop the stream of fuel 192 and circumferentially compress the stream of fuel 192 into a smaller spray cone 182. The size of the gas envelope may be adjusted by increasing or decreasing the flow rate and/or pressure of the second flow of gas 202. Increasing the flow rate and/or pressure of the second gas flow 202 may result in higher compression that in turn creates a smaller opening angle θ183 of the spray cone 182. Decreasing the flow rate and/or pressure of the second gas flow 202 may result in lower compression that in turn creates a larger opening angle θ183 of the spray cone 182. Accordingly, an optimal flow ratio between the flow rate of the first gas passage 196 and the flow rate of the second gas passage 198 may be adjusted so as to optimize gasification operations.

A high flow ratio, i.e., higher flow rate through the first gas passage 196 and lower flow rate through the second gas passage 198, may result in a broader opening angle θ183. A low flow ratio, i.e., lower flow rate through the first gas passage 196 and higher flow rate through the second gas passage 198, may result in a tighter opening angle θ183. Reducing the opening angle θ183 of the spray cone 182 may allow for increased lifespan of gasifier 106 components such as refractory linings, fuel injectors 178, moderator injectors, and so forth because of the corresponding reduction in temperatures and pressures experienced by aforementioned components. Indeed, the gasification controller 107 is capable of closely monitoring gasification data and controlling the opening angle θ183 and size of the spray cone 182 so as to maximize gasification efficiency and minimize component wear as described below.

The gasification controller 107 may receive a plurality of measurements, for example, temperature, pressure, humidity, moderator flow rate, flame characteristics, syngas composition, and so forth. The gasification controller 107 may then use the measurements to optimize the spray cone 182, as well as the amount of fuel 192 being used in gasification operations. For example, if too little syngas is being produced, then the controller 107 may add fuel 192 and/or create a broader spray cone 182 by adjusting the flow ratio of the flow of oxygen through the two gas passages 196, 198. If elevated temperatures and/or pressures are detected in the gasifier 106, then the controller 107 may reduce the amount of fuel 192 and/or create a narrower spray cone 182. Indeed, the controller 107 is capable of efficiently optimizing gasification operations by controlling fuel rates and by creating any number of feedstock spray cones 182.

Figure 4:
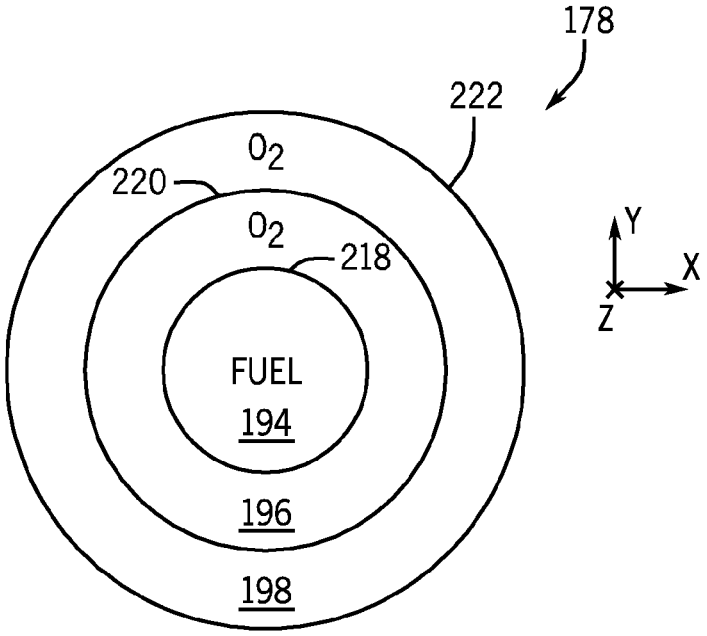
FIG. 4 depicts a simplified cross-sectional view of an embodiment of the gasification fuel injector as depicted through line 4 of FIG. 3.

FIG. 4 is a simplified cross-sectional view through line 4 of an embodiment of the fuel injector 178 of FIG. 3. That is, FIG. 4 depicts a cross-sectional slice through a plane defined by line 4 of FIG. 3, illustrating an embodiment of concentric and/or coaxial placement of the passages 194, 196, and 198. In the depicted embodiment, the passages 194, 196, and 198 may be concentrically and/or coaxially placed around a common axis, such as the axis 204 (shown in FIG. 3) that projects parallel to the z-plane. In other embodiments, the passages 194, 196, and 198 may not share a common axis and may be placed off-center with respect to each other. The fuel passage 194 is a circular fuel passage placed in the center of the fuel injector 178, as depicted. The first gas passage 196 is an annular or toroidal (i.e., circular with a hollow center) gas passage 196 placed to circumferentially surround the fuel passage 194. Accordingly, the first gas passage 196 aids in atomizing the fuel 192. A circular wall 218 separates the passages 194 and 196. The second gas passage 198 is also an annular or toroidal gas passage 198 and is placed to circumferentially surround the first gas passage 196. Consequently, the second gas passage 198 aids in creating a gas stream capable of enveloping the atomized fuel 192. A circular wall 220 separates the passages 196 and 198. An exterior circular wall 222 separates the second gas passage 198 from the remainder of the fuel injector 178. In certain embodiments, the exit outlets 195, 197, and 199 (shown in FIG. 3) corresponding to the passages 194, 196, and 198 may also include a similar concentric and/or coaxial arrangement, such that the fuel outlet 197 is placed at the approximate center with the gas outlets 197, 199 concentrically and/or coaxially surrounding the fuel outlet 197.

Figure 5:
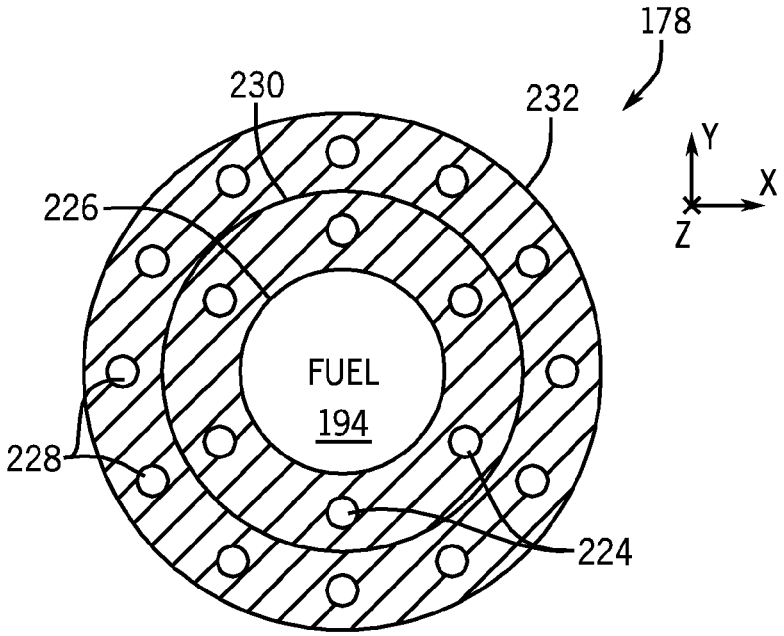
FIG. 5 depicts another simplified cross-sectional view of an embodiment of the gasification fuel injector.

FIG. 5 is a simplified cross-sectional frontal view of another embodiment of the fuel injector 178, with the cross-section shown in the same plane as that of FIG. 4. In the depicted embodiment, the fuel injector 178 includes a plurality of discrete outlet ports that may be used as transport conduits and/or outlets for the first and second gas flows. Accordingly, the first gas flow 200 may be redirected into the gasifier 108 through a plurality of discrete outlet ports 224. The discrete outlet ports 224 may be equidistantly placed so as to circumferentially surround the fuel passage 195. In the depicted embodiment, each discrete outlet port 224 has the same diameter as each other discrete outlet port 224. In other embodiments, each discrete outlet port 224 may have a different diameter from the other discrete outlet ports 224. A circular wall 226 separates the fuel passage 195 from the discrete outlet ports 224. The second gas flow 202 may be redirected into the gasifier 108 through a plurality of discrete outlet ports 228. The discrete outlet ports 228 may also be equidistantly placed so as to circumferentially surround the discrete outlet ports 224. In the depicted embodiment, each discrete outlet port 228 has the same diameter as each other discrete outlet port 228. In other embodiments, each discrete outlet port 228 may have a different diameter from the other discrete outlet ports 228. A circular wall 230 separates the discrete outlet ports 224 from the discrete outlet ports 228, and an exterior circular wall 232 separates the discrete outlet ports 228 from the remainder of the fuel injector 178. It is to be understood that while the depicted embodiment illustrates six discrete outlet ports 224 and twelve discrete outlet ports 228, other embodiments may have more or less discrete outlet ports 224, 228.

Figure 6:
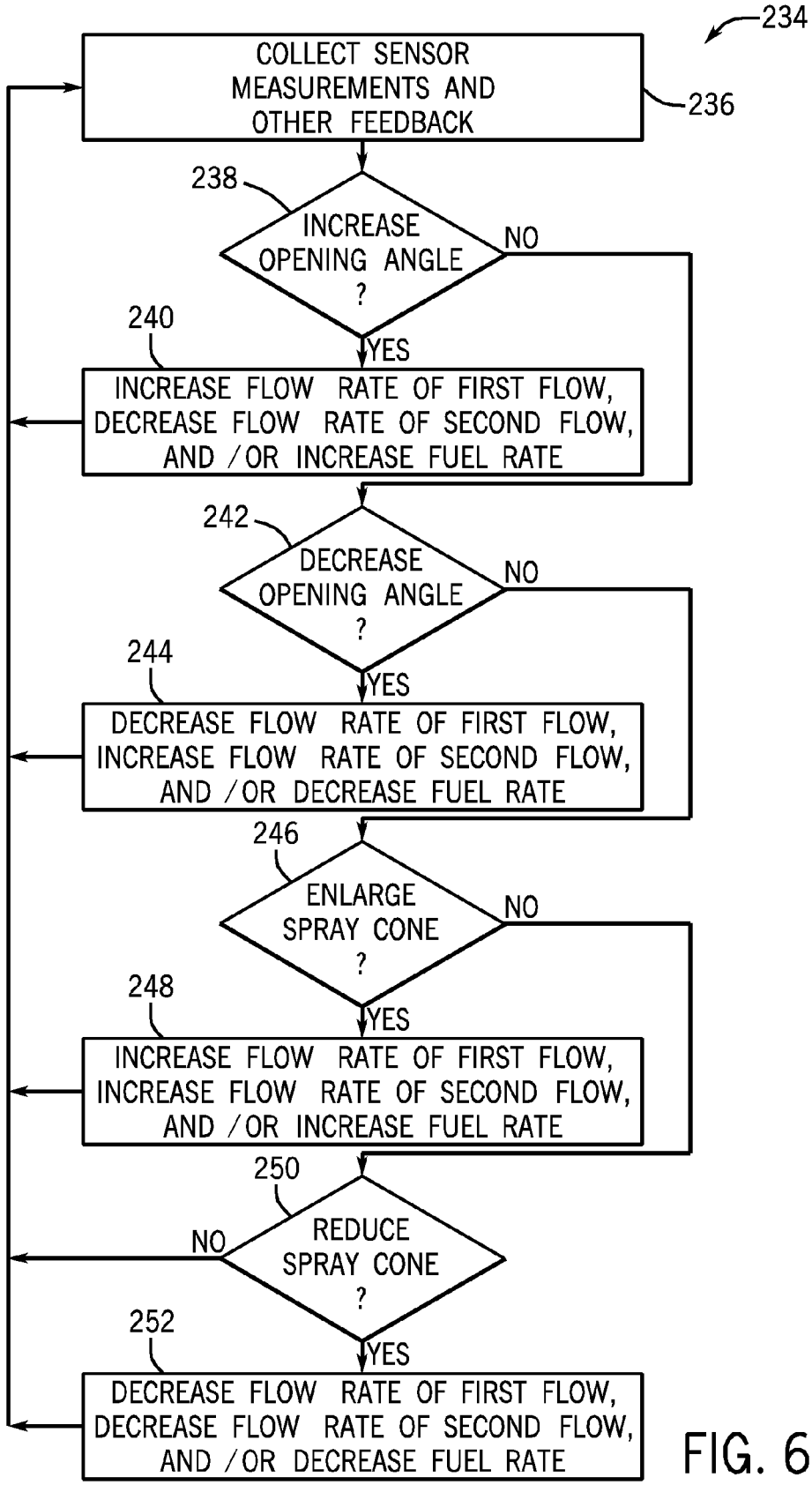
FIG. 6 depicts a flowchart of an embodiment of a method for injecting feedstock and a gas.

FIG. 6 is a flowchart of an embodiment of control logic 234 that may be used, for example, by the gasification controller 107 to adjust the size and opening angle θ183 of the spray cone 182 during gasification operations. Accordingly, each block of the logic 234 may include machine readable code or computer instructions that can be executed by the controller 107. The logic 234 may first collect gasification measurements and other feedback (block 236). As mentioned above, the controller 107 may receive a plurality of sensor 184 measurements and other feedback 186 from gasifier 106 activities and from other IGGC plant 100 activities. The controller 107 may then use the collected data to determine if it would beneficial to increase the existing opening angle θ183 of the spray cone 182 (decision 238). It may be beneficial to increase the opening angle θ183, for example, if the gasifier 106 is operating at a lower temperature or at a lower gasification pressure than desired. Accordingly, the opening angle θ183 of the spray cone 182 may be enlarged by increasing the flow rate of the first gas flow 200, decreasing the flow rate of the second gas flow 202, and/or increasing the flow rate of the feedstock (block 240).

If the controller 107 determines that it would not be beneficial to increase the existing opening angle θ183 of the spray cone 182, the controller may then determine if it may be beneficial to decrease the existing opening angle θ183 of the spray cone 182 (decision 242). It may be beneficial to decrease the existing opening angle θ183 of the spray cone 182, for example, if the gasifier 106 is operating at a higher temperature or at a higher gasification pressure than desired. Accordingly, the opening angle θ183 of the spray cone 182 may be reduced by decreasing the flow rate of the first gas flow 200, increasing the flow rate of the second gas flow 202, and/or decreasing the flow rate of the feedstock (block 244).

In certain operating modalities, it may be beneficial to increase the size of the spray cone 182 while keeping the opening angle θ183 at approximately the same angle. For example, a longer spray cone 182 may result in an increase in the gasification yield while keeping the temperature experienced by the refractory lining proximate to the spray cone 182 to remain at approximately the same temperature. Similarly, a different fuel having a low heating value (i.e., a measure of intrinsic energy in the fuel) may benefit from a longer spray cone 182 in order to more efficiently burn the fuel. Accordingly, the controller 107 may determine if it would be beneficial to increase the size of the spray cone 182 while keeping the opening angle θ183 at approximately the same angle (decision 246). If the controller 107 determines that an enlarged spray cone would be beneficial; then the controller 107 may increase the flow rate of the feedstock, increase the flow rate of the first gas flow, and/or increase the flow rate of the second gas flow (block 248). The resulting longer spray cone 182 may be at approximately the same opening angle θ183 as the previous shorter spray cone 182.

In other operating modalities, it may be beneficial to decrease the size of the spray cone 182 while keeping the opening angle θ183 at approximately the same angle. For example, a different fuel type may contain a higher heating value and thus may benefit from a shorter spray cone 182 in order to optimize burn characteristics of the fuel. Accordingly, the controller 107 may determine if it would be beneficial to reduce the size of the spray cone 182 while keeping the opening angle θ183 at approximately the same angle (decision 250). If the controller 107 determines that a reduced spray cone would be beneficial; then the controller 107 may decrease the flow rate of the feedstock, decrease the flow rate of the first gas flow 200, and/or decrease the flow rate of the second gas flow 202 (block 252). The resulting reduced spray cone 182 may be at approximately the same opening angle θ183 as the previous larger spray cone 182. The controller 107 may be iteratively determining optimal opening angles θ183 and spray cone 182 sizes. Accordingly, the depicted embodiment illustrates a return to the collection of sensor measurements and other feedback (block 236) as the controller 107 continuously iterates through the logic 234. Indeed, by iteratively controlling the flow rates of the feedstock and of the two gases, the controller 107 is capable of creating any number of spray cones 182 at any number of angles θ183. Such capabilities allow the gasification process to be efficiently optimized for a wide variety of fuel types, gasifier types, and gasification operations. Indeed, the controller 107 may be continuously varying the solid fuel flow rate, the first gas flow rate, and the second gas flow rate throughout all phases of plant 100 operation, from a plant start up condition to a steady state condition to a plant shutdown condition of the gasifier 106.

Technical effects of the invention include a fuel injector with a plurality of fuel and gas passages and a gasification controller capable of varying the flow rates of the fuel and the gas for controlling the size and opening angle of a spray cone of feedstock. The spray cone size and opening angle may be varied so as to optimally gasify any number of fuel types in any number of gasification operations. The gasification controller is capable of on-line control of the size and opening angle of the spray cone of feedstock. The fuel injector and gasification controller are thus capable of enhanced flexibility of gasification fuel injection operations through a wide range of conditions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a solid fuel injector, comprising:

a solid fuel passage disposed axially with respect to the solid fuel injector and configured to inject a solid fuel through a fuel outlet in a fuel direction; and a first gas passage configured to inject a first gas through a first gas outlet in a first gas direction, wherein the first gas direction is oriented at a first angle relative to the fuel direction;

a second gas passage configured to inject a second gas through a second gas outlet in a second gas direction, wherein the second gas direction is oriented at a second angle relative to the fuel direction, and the first and second angles are different from one another, wherein the first gas passage is disposed concentrically surrounding the solid fuel passage, and the second gas passage is disposed concentrically surrounding the first gas passage;

a fuel pump fluidly coupled to the solid fuel passage and communicatively coupled to a controller, wherein the fuel pump is configured to direct the solid fuel into the solid fuel passage;

a first valve fluidly coupled to the first gas passage and communicatively coupled to the controller, wherein the first valve is configured to adjust a first flow of the first gas through the first passage; and a second valve fluidly coupled to the second gas passage and communicatively coupled to the controller, wherein the second valve is configured to adjust a second flow of the second gas through the second passage; and the controller configured to inject the solid fuel axially with respect to the solid fuel injector by actuating the fuel pump, inject the first gas concentrically about the solid fuel passage to impact the solid fuel by actuating the first valve, and inject the second gas concentrically about the first gas passage to impact the first gas, the solid fuel, or a combination thereof, by actuating the second valve.

2. The system of claim 1, wherein the controller is configured to adjust a first gas flow rate of the first gas by adjusting the first valve and a second gas flow rate of the second gas by adjusting the second valve.

3. The system of claim 2, wherein the controller is configured to adjust a ratio between the first and second gas flow rates to adjust a spray angle of the solid fuel by adjusting the first valve, the second valve, or a combination thereof.

4. The system of claim 2, wherein the controller is configured to adjust a fuel flow rate of the solid fuel relative to the first gas flow rate, the second gas flow rate, or a combination thereof, by adjusting the fuel pump.

5. The system of claim 4, wherein the controller is configured to adjust the fuel flow rate, the first gas flow rate, or the second gas flow rate, in response to feedback from a combustion chamber.

6. The system of claim 5, wherein the feedback comprises gasifier feedback from the combustion chamber of a gasifier.

7. The system of claim 6, comprising the gasifier coupled to the solid fuel injector.

8. The system of claim 1, wherein the first gas passage is a first annular passage, and the second gas passage is a second annular passage.

9. The system of claim 1, wherein the fuel outlet, the first gas outlet, and the second gas outlet are disposed in a common plane.

10. The system of claim 1, wherein the solid fuel passage is a coal passage, the first gas passage is a first oxygen passage, and the second gas passage is a second oxygen passage.

11. A system, comprising:

a solid fuel injection controller configured to control a solid fuel flow rate of a solid fuel in a fuel direction from a solid fuel injector, wherein a fuel pump is fluidly coupled to a solid fuel passage disposed axially with respect to the solid fuel injector and communicatively coupled to the solid fuel injection controller, wherein the fuel pump is configured to direct the solid fuel into the solid fuel passage, a first gas flow rate of a first gas flowing in a first gas direction from the solid fuel injector through a first gas passage, wherein a first valve is fluidly coupled to the first gas passage and communicatively coupled to the solid fuel injection controller, and a second gas flow rate of a second gas flowing in a second gas direction from the solid fuel injector through a second gas passage, wherein a second valve is fluidly coupled to the second gas passage and communicatively coupled to the solid fuel injection controller, wherein the first gas passage is disposed concentrically surrounding the solid fuel passage, and the second gas passage is disposed concentrically surrounding the first gas passage, and wherein the solid fuel injector controller is configured provide the fuel direction axially with respect to the solid fuel injector by actuating the fuel pump, the solid fuel injector controller is configured to provide the first gas direction to concentrically surround the fuel direction by actuating the first valve, and the solid fuel injector controller is configured to provide the second gas direction to concentrically surround the first gas direction by actuating the second valve.

12. The system of claim 11, wherein the solid fuel injection controller is configured to adjust a ratio between the first and second gas flow rates to adjust a spray angle of the solid fuel exiting from the solid fuel injector by adjusting the first valve, the second valve, or a combination thereof.

13. The system of claim 11, wherein the solid fuel injection controller is configured to adjust the solid fuel flow rate relative to the first gas flow rate by adjusting the fuel pump, the first valve, or a combination thereof, or the second gas flow rate by adjusting the fuel pump, the second valve, or a combination thereof, to control breakup of the solid fuel.

14. The system of claim 13, wherein the solid fuel injection controller is configured to adjust the solid fuel flow rate, the first gas flow rate, or the second gas flow rate, in response to feedback from at least component of an integrated gasification combined cycle (IGCC) system.

15. The system of claim 11, wherein the solid fuel flow rate is a coal flow rate, the first gas flow rate is a first oxygen flow rate, and the second gas flow rate is a second oxygen flow rate, wherein the first gas direction is oriented at a first angle relative to the fuel direction, the second gas direction is oriented at a second angle relative to the fuel direction, and the second angle is at least approximately 5° greater than the first angle.

16. A method, comprising:

controlling a solid fuel flow rate of a solid fuel traversing a solid fuel passage in an axial fuel direction from a solid fuel injector by actuating a fuel pump;

controlling a first gas flow rate of a first gas traversing a first gas passage in a first gas direction from the solid fuel injector, wherein the first gas direction is oriented at a first angle relative to the fuel direction by actuating a first valve fluidly coupled to the first gas passage, wherein the first gas passage is disposed concentrically surrounding the solid fuel passage; and controlling a second gas flow rate of a second gas traversing a second gas passage in a second gas direction from the solid fuel injector, wherein the second gas direction is oriented at a second angle relative to the fuel direction by actuating a second valve fluidly coupled to the second gas passage, wherein the second gas passage is disposed concentrically surrounding the first gas passage, and the first and second angles are different from one another.

17. The method of claim 16, comprising gasifying a spray of the solid fuel from the solid fuel injector.

18. The method of claim 16, comprising adjusting a first ratio between the solid fuel flow rate and the first gas flow rate to control breakup of the solid fuel, and adjusting a second ratio between the first and second gas flow rates to adjust a spray angle of the solid fuel exiting from the solid fuel injector.

19. The method of claim 16, comprising varying the solid fuel flow rate, the first gas flow rate, and the second gas flow rate from a start up condition to a steady state condition to a shutdown condition of a gasifier.

* * * * *